US006323817B1

(12) United States Patent
Ramanujam et al.

(10) Patent No.: US 6,323,817 B1
(45) Date of Patent: Nov. 27, 2001

(54) ANTENNA CLUSTER CONFIGURATION FOR WIDE-ANGLE COVERAGE

(75) Inventors: Parthasarathy Ramanujam, Redondo Beach; Stephen A. Robinson, North Hills; Philip H. Law, Encino, all of CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/488,205

(22) Filed: Jan. 19, 2000

(51) Int. Cl.[7] ..... H01Q 13/00

(52) U.S. Cl. ..... 343/781 P; 343/754; 343/781 CA; 342/352

(58) Field of Search ..... 343/753, 754, 343/755, 781 P, 781 CA; 342/352, 354, 357, 360, 368, 371

(56) References Cited

U.S. PATENT DOCUMENTS 5,642,358 * 6/1997 Dent ..... 370/323
5,652,597 * 7/1997 Caille ..... 343/756
5,945,946 * 8/1999 Munger ..... 342/367
6,160,519 * 12/2000 Hemmi ..... 343/754
6,184,828 * 2/2001 Shoki ..... 342/368

* cited by examiner

*Primary Examiner*—Don Wong
*Assistant Examiner*—Shih-Chao Chen
(74) *Attorney, Agent, or Firm*—Terje Gudmestead

(57) ABSTRACT

A method and apparatus for producing contiguous spot beam communications coverage on the Earth's surface are disclosed. The apparatus comprises an antenna system including two wide scan antennas and two narrow scan antennas. The two wide scan antennas are disposed substantially opposite each other, and the two narrow scan antennas are disposed substantially opposite each other and substantially normal to the wide scan antennas. The first wide scan antenna, second wide scan antenna, and first narrow scan antenna produce a first beam pattern on a planetary surface and the first wide scan antenna, second wide scan antenna, and second narrow scan antenna produce a second beam pattern on the planetary surface.

22 Claims, 10 Drawing Sheets

ANTENNA CLUSTER CONFIGURATION FOR WIDE-ANGLE COVERAGE

BACKGROUND OF THE INVENTION

1. Field of the Invention

This invention relates in general to antenna systems, and in particular to an antenna cluster configuration for wide-angle coverage.

2. Description of Related Art

Communications satellites have become commonplace for use in many types of communications services, e.g., data transfer, voice communications, television spot beam coverage, and other data transfer applications. As such, satellites must provide signals to various geographic locations on the Earth's surface. As such, typical satellites use customized antenna designs to provide signal coverage for a particular country or geographic area.

In order to provide signal coverage over a large area, several approaches are used. A single beam with a wide beamwidth is sometimes used, but is limited in terms of power delivery over such a large geographic area. Typically, to cover a large geographic area, contiguous spot beams are used.

Contiguous spot beams are generated by multiple antennas to cover a large geographic area with a small variation in measured signal strength at the ground. However, in order to generate high-performance beams over the northern and southern hemisphere with a single spacecraft, it is necessary to use either a three to four wide-scan antenna configuration, or a six narrow-scan antenna configuration.

A wide scan antenna is typically a Side Feed Offset Cassegrain (SFOC) or a lensed antenna. Currently, spot-beam satellites using Ku and Ka-band communications links require antenna apertures of 100 inches. Accommodating four one hundred inch apertures on a single spacecraft is difficult. For example, the SFOC geometries are suitable on the East and West sides of the spacecraft, but not on the nadir of the spacecraft. The alternative six narrow-scan antenna configuration also required complex mechanical packaging.

It can be seen, then, that there is a need in the art for antenna systems that can deliver contiguous spot beams over large geographic areas. It can also be seen that there is a need in the art for antenna systems that can deliver contiguous spot beam coverage over both the Northern and Southern hemispheres. It can also be seen that there is a need in the art for antenna systems that provide ease of mechanical design and construction to reduce spacecraft costs.

SUMMARY OF THE INVENTION

To overcome the limitations in the prior art described above, and to overcome other limitations that will become apparent upon reading and understanding the present specification, the present invention discloses a method and apparatus for producing contiguous spot beam communications coverage on the Earth's surface. The apparatus comprises an antenna system including two wide scan antennas and two narrow scan antennas. The two wide scan antennas are disposed substantially opposite each other, and the two narrow scan antennas are disposed substantially opposite each other and substantially normal to the wide scan antennas. The first wide scan antenna, second wide scan antenna, and first narrow scan antenna produce a first beam pattern on a planetary surface and the first wide scan antenna, second wide scan antenna, and second narrow scan antenna produce a second beam pattern on the planetary surface.

The present invention provides an antenna system that provides contiguous spot beams over large geographic areas. The present invention also provides antenna systems that can deliver contiguous spot beam coverage over both the Northern and Southern hemispheres. The present invention also provides antenna systems that provide ease of mechanical design and construction to reduce spacecraft costs.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Overview of Related Art

Contiguous spot beam coverage is commonly used in many satellite antenna designs, especially in Ka band applications that require higher antenna gains to compensate for severe propagation effects. A typical approach to achieve higher gain is to use a feed array aligned with a reflector or a lens antenna, where each of the feeds generates a single spot beam. However, this approach is not very efficient since the overlap requirement of the beams dictates that the size of the feed horns be relatively small, resulting in a loss in directivity due to feed horn spillover.

Another approach for obtaining contiguous spot beams is to use multiple antennas. In this approach, adjacent beams are always generated by the $2^{nd}$ or $3^{rd}$, and $2^{nd}$ or $3^{rd}$ or $4^{th}$ antenna, to generate contiguous spot beam coverage. Hence, the adjacent beam from the same antenna is further away in comparison to a single antenna solution. This allows a larger feed to be used for generating each beam, resulting in improved gain and sidelobe performance. However, to generate coverage in both the Northern and Southern Hemispheres using this approach requires mechanical complexity on the spacecraft to allow deployment of large antenna reflectors on the North, South, East and West positions on the spacecraft.

Figure 1:
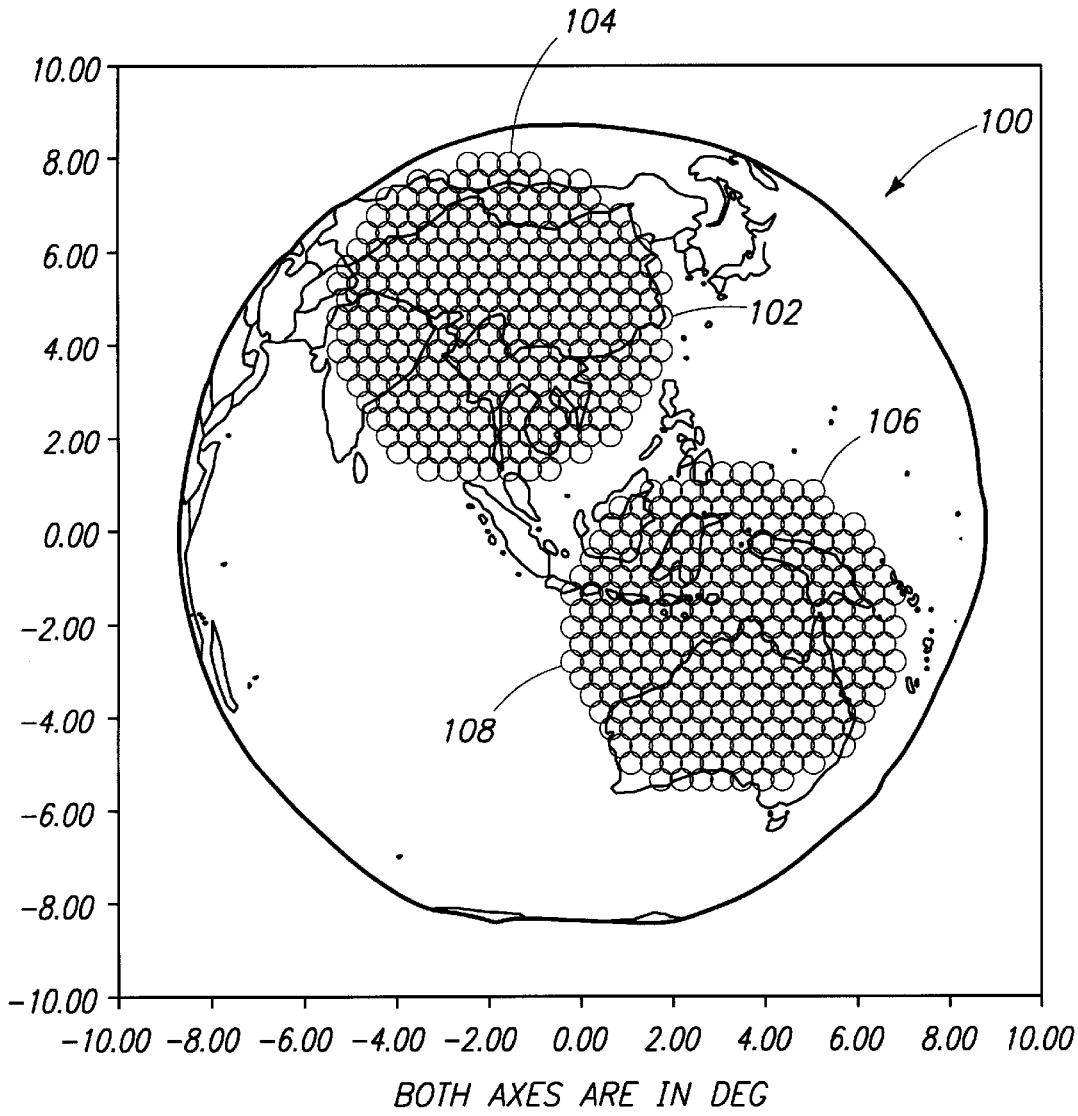
FIG. 1 illustrates a typical satellite perspective of the Earth with multiple desired beam patterns.

FIG. 1 illustrates a typical satellite perspective of the Earth with multiple desired beam patterns. Earth 100 is shown from the perspective of a satellite, typically a satellite in geosynchronous orbit.

The satellite provides communications signals, called beams, that provide the proper signal strength to communicate with antennas on the Earth's 100 surface. However, because of power limitations, desired coverage areas, etc., a single antenna cannot provide coverage for the entire visible portion of the Earth's 100 surface. Specific geographic areas are selected by the satellite designer for communications coverage. The satellite typically provides communications services in one or more selected geographic areas by using multiple antenna beams.

As shown in FIG. 1, a spacecraft typically must deliver a communications signal to desired locations on the surface of the Earth 100. As communications services demand increases, the size of the geographic locations increases as well. Currently, typical coverage for communications satellites includes locations in the Northern and Southern Hemispheres.

Location 102, shown in the Northern Hemisphere, is typically covered using spot beams 104, whereas location 106, shown in the Southern Hemisphere, is typically covered using spot beams 108. In order to generate high-performance beams over both hemispheres, it is necessary to use 3 or 4 wide-scan antennas or 6 to 8 narrow-scan antennas to provide spot beams 104 and 108.

However, satellites and launch vehicles cannot always accommodate four antennas with apertures of one hundred inch diameter. Consequently, the satellite either cannot provide the coverage shown by beams 104 and 108, or multiple satellites must be launched to provide the beams 104 and 108. Other constraints on the satellite, e.g., power, weight, size, and launch vehicle payload constraints would typically limit the satellite to either smaller geographic areas 102 and 106 or eliminate one of the beam patterns 104 or 108. Further, the bulky shape of typical wide-scan antenna systems complicates the design of the satellite. The extra expense of multiple satellites, as well as the design costs of packaging and designing an antenna system that could provide beam patterns 104 and 108, increases the cost of communications services.

Figure 2:
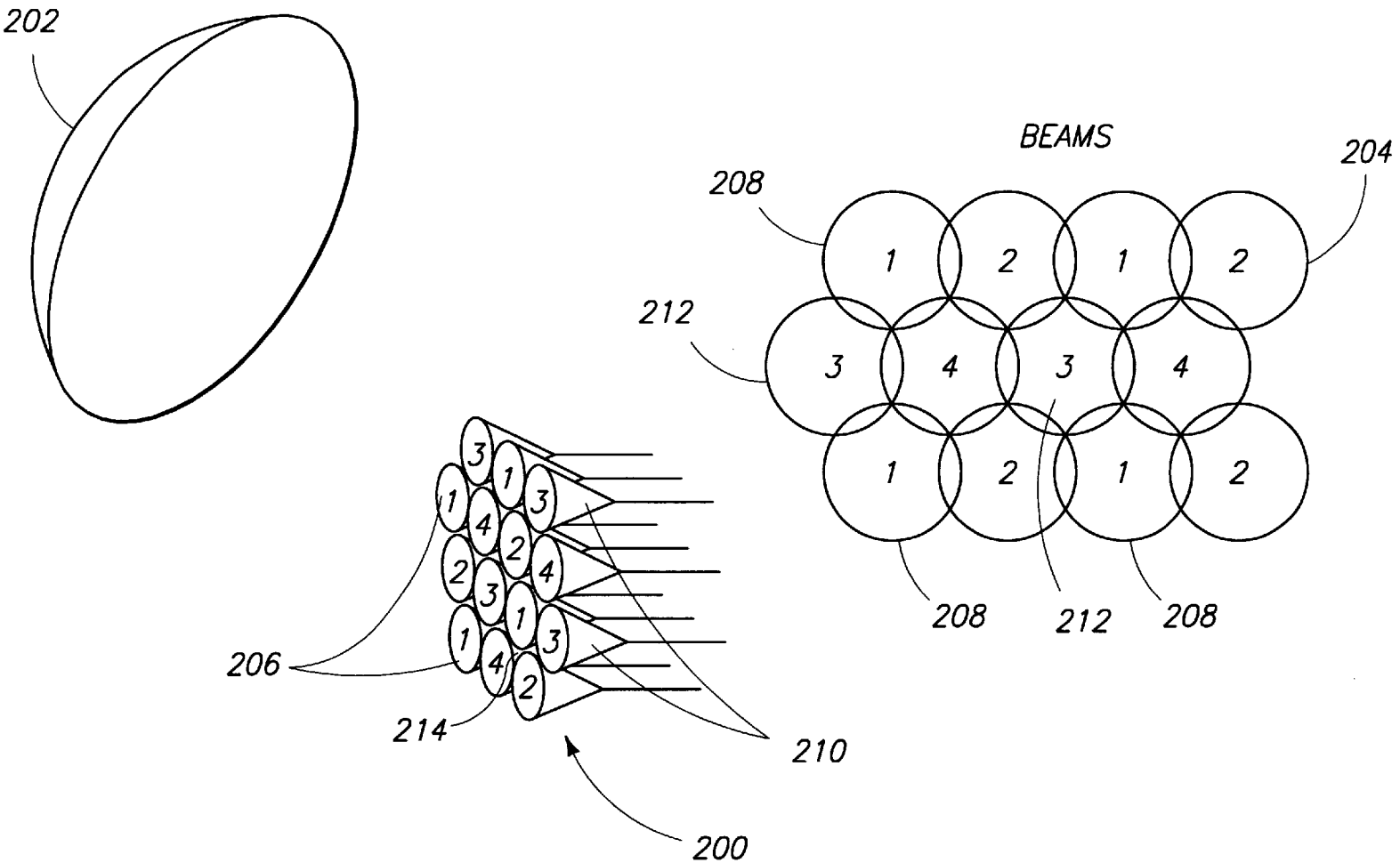
FIG. 2 illustrates a related art method for generating contiguous spot beams using a single reflector.

FIG. 2 illustrates a related art method for generating contiguous spot beams using a single reflector. Contiguous spot beam coverage can be obtained by using several feed horns 200 and a single reflector 202 to generate beam pattern 204, which is similar to spot beams 104 and 108 of FIG. 1. Feed horns 206, labeled "1" for ease of illustration, are excited to generate spot beam 208, whereas feed horns 210, labeled "3" for ease of illustration, are excited to generate spot beams 212. Similarly, the remaining feed horns 200 are excited to generate the remaining spot beams in beam pattern 204. This antenna configuration provides poor uniformity of signal strength in beam pattern 204 because feed horns 200 that are required for such a configuration need to be large, and, as such, the interstitial sites 214 between the feed horns 200 become large. As such, the continuity and uniformity of the beam pattern 204 is degraded.

Figure 3:
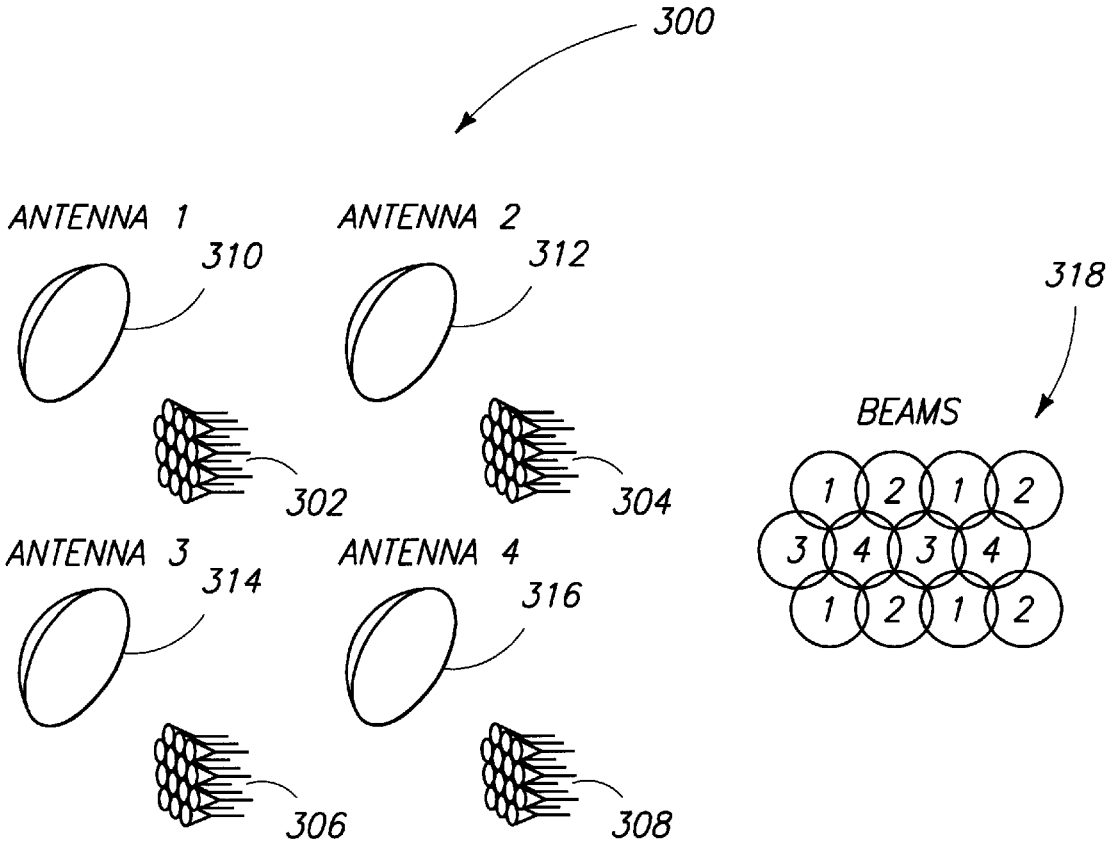
FIG. 3 illustrates a related art method for generating contiguous spot beams using multiple reflectors.

FIG. 3 illustrates a related art method for generating contiguous spot beams using multiple reflectors.

Antenna system 300 employs four separate banks of feed horns 302–308 and four separate reflectors 310–316 to generate beam pattern 318, which is obtained with no beam-forming. It is desirable that all of the reflectors 310–316 and feed horns 302–208 have similar performance over the desired geographic region that is covered by beam pattern 318. Typical antenna geometries which are capable of scanning a wide-angle, about 10 degrees, are Side-Fed Offset Cassegrain (SFOC) and symmetric lens geometries. For a wide-angle coverage such as that shown in FIG. 2, it is desirable that all of the reflectors 310–316 be capable of achieving good scan performance over both regions 102 and 106. To accomplish this on a single spacecraft, all four reflectors 310–316 must be packaged on the spacecraft, which is difficult given that each reflector 310–316 is 100 inches in diameter. Many spacecraft designs cannot package three or four large reflectors as required in the antenna system 300.

Overview of the Invention

The current invention discloses a technique of combining two wide-scan and two limited-scan antennas, properly placed on the spacecraft, to achieve the performance of three wide-scan or six narrow-scan antennas. This approach results in a simpler mechanical packaging on the spacecraft, and as such, reduces design and launch costs.

The present invention benefits any satellite using spot beams for surface coverage, because it allows additional design freedom and increased geographic area coverage for high data rate applications. The present invention provides a simpler method for accommodating antennas that generate about 0.4 deg spot beams at Ka band over a wide-angle.

Figure 4A:
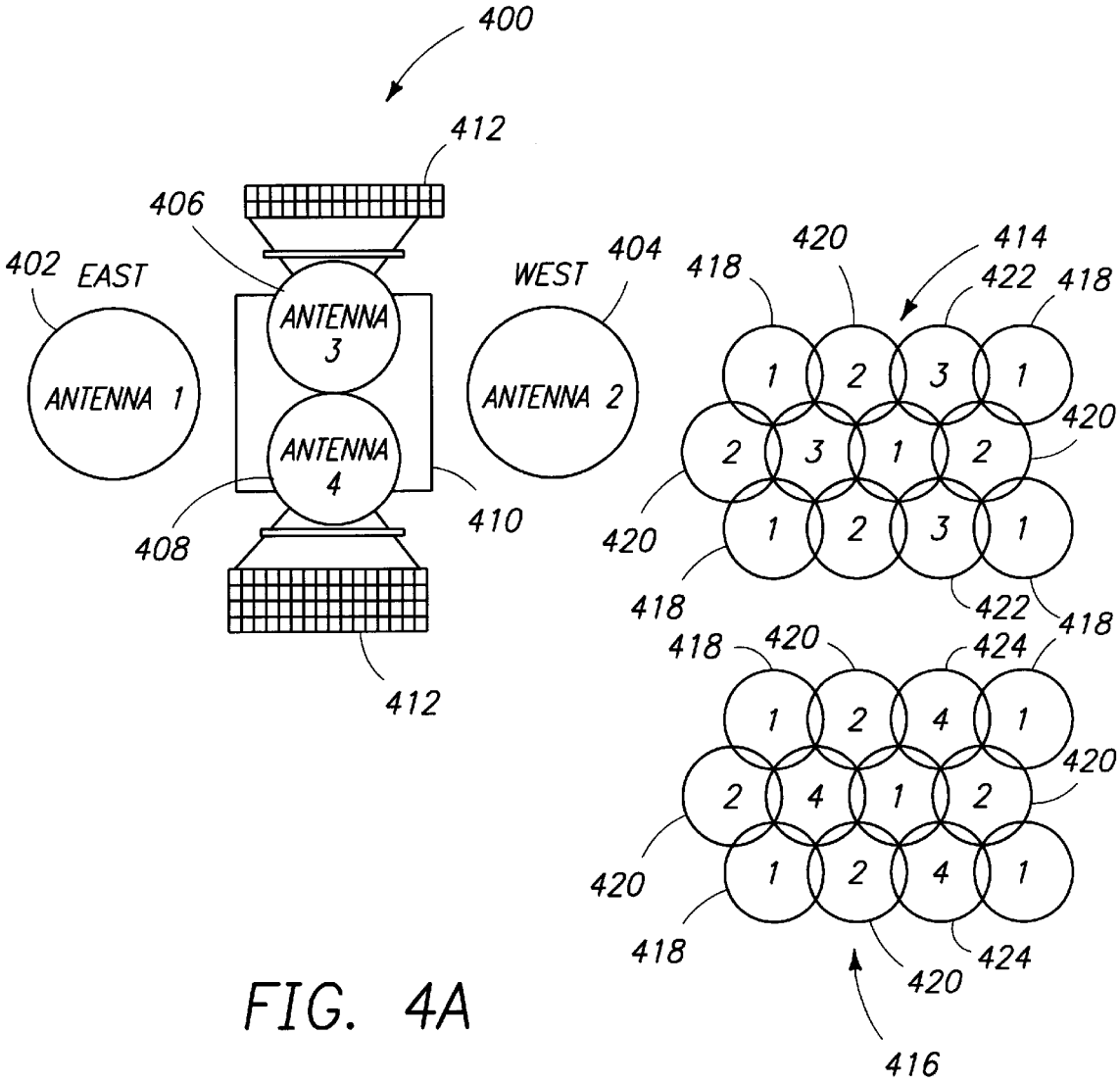
FIG. 4A illustrates a block diagram of an embodiment of the present invention.

FIG. 4A illustrates a block diagram of an embodiment of the present invention. Antenna system 400 comprises four antennas 402–408. Antenna 1 402 is located on the East face of the spacecraft bus 410, antenna 2 404 is located on the West face of spacecraft bus 410, antenna 3 406 is located on the North part of the nadir face of the spacecraft bus 410, and antenna 4 408 is located on the South part of the nadir face of the spacecraft bus 410. Solar panels 412 are also shown for clarity. Although described with respect to North, South, East, and West orientations on the spacecraft bus 410, these orientations are presented for purposes of illustration. For example, the spacecraft bus 410 can be reoriented to position antenna 3 406 on a West face, East face, or South face of the spacecraft bus 410 without departing from the scope of the invention.

Antennae 1 402 and 2 404 are capable of wide-scan performance, e.g., up to 9 degrees, whereas antennas 3 406 and 4 408 have limited scan or narrow scan performance, e.g., up to 5 degrees. As such, the mechanical complexity required to stow and deploy antennas 3 406 and 4 408 is reduced. Typically, antenna 1 402 and antenna 404 are SFOC antennas, but can be phased array antennas or other wide-scan antenna geometries.

Beam pattern 414 is generated by antennas 1 402, 2 404, and 3 406, and beam pattern 416 is generated by antennas 1 402, 2 404, and 4 408. For example, spots 1 418 are generated by antenna 1 402, regardless of whether they are in beam pattern 414 or 416.

Spots 2 420 are generated by antenna 2 404, regardless of whether they are in beam pattern 414 or 416. Spots 3 422 are generated by antenna 3 406, and are only used in beam pattern 414. Spots 4 424 are generated by antenna 4 408, and are only used in beam pattern 416. Beam pattern 414 is used for geographic coverage in the Northern Hemisphere, whereas beam pattern 416 is used for geographic coverage in the Southern Hemisphere. To obtain better geographic coverage, it is desirable to bias antenna 3 406 towards the North, and antenna 4 408 towards the South. As such, beam patterns 414 and 416 are equivalent to the beam patterns shown in FIG. 1.

Figure 4B:
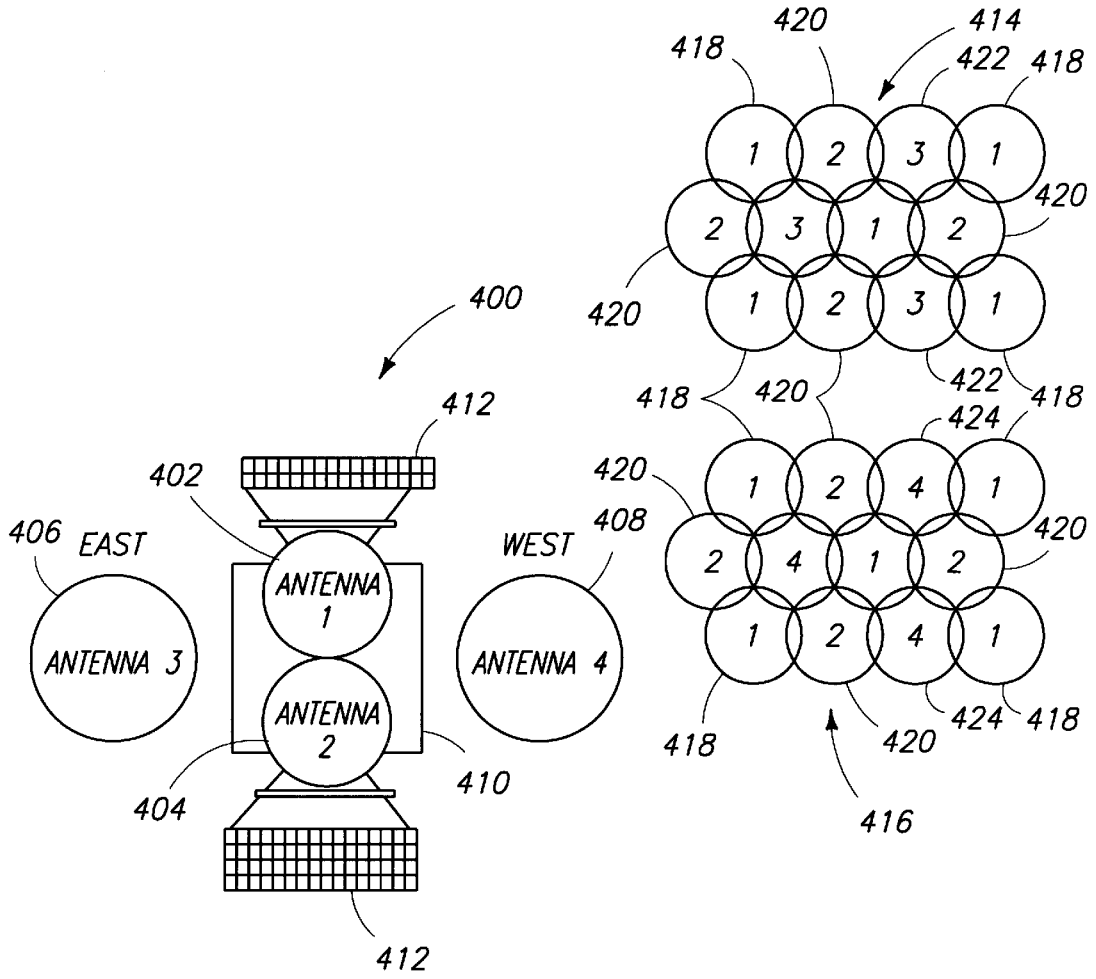
FIG. 4B illustrates an alternative embodiment of the present invention.
Figure 5A:
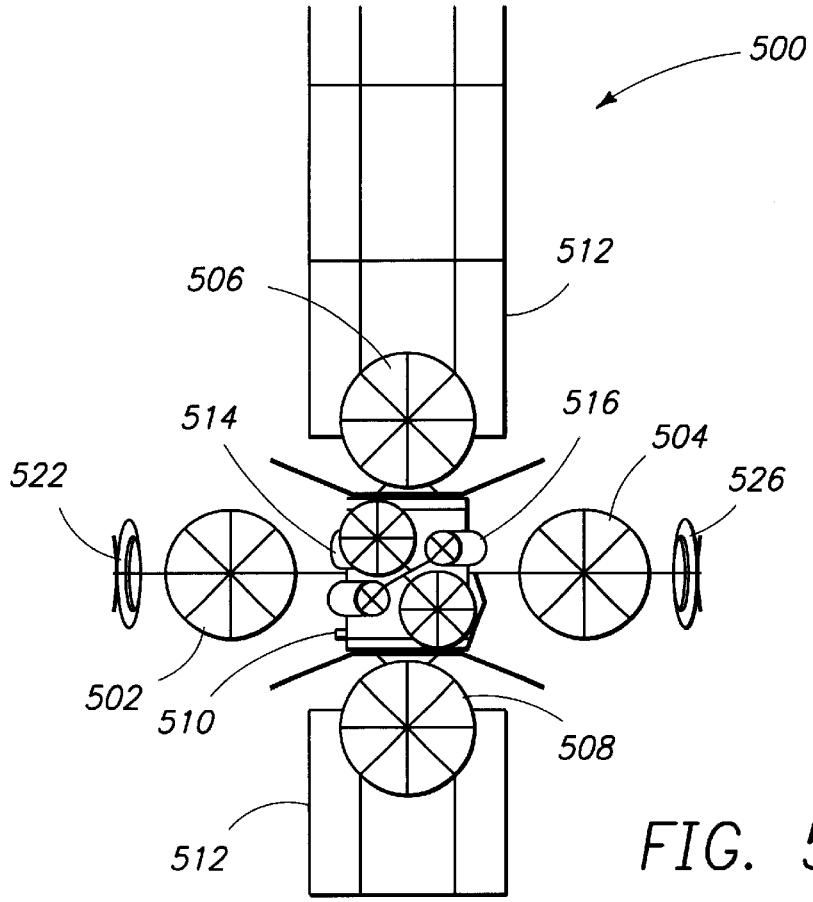
FIGS. 5A–5E illustrate a typical spacecraft antenna configuration employing the present invention.
Figure 5B:
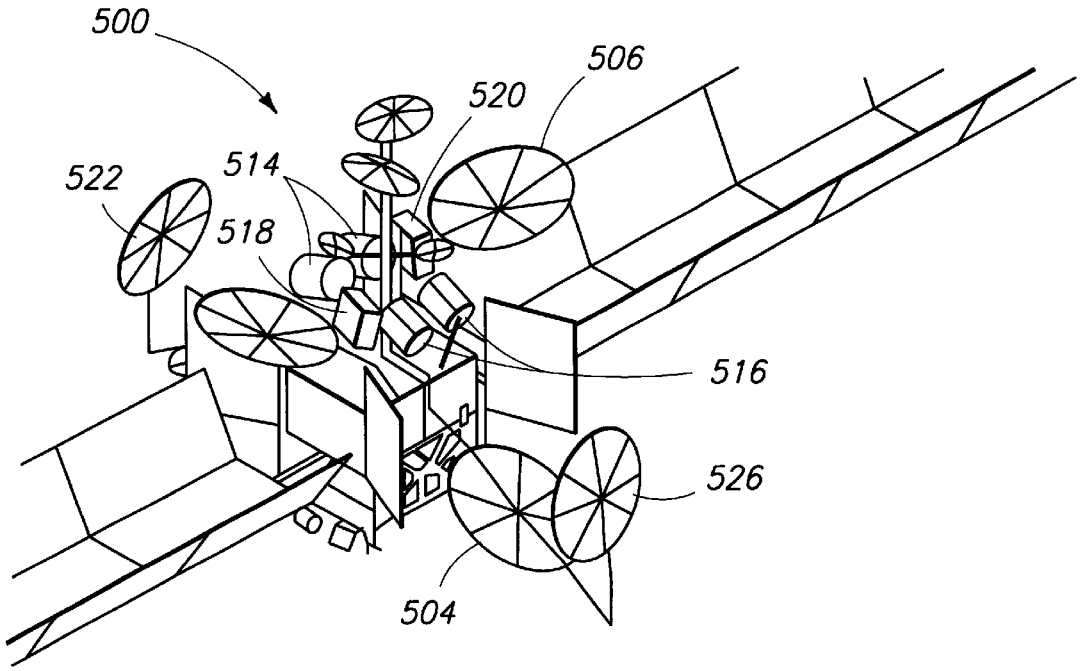
Figure 5C:
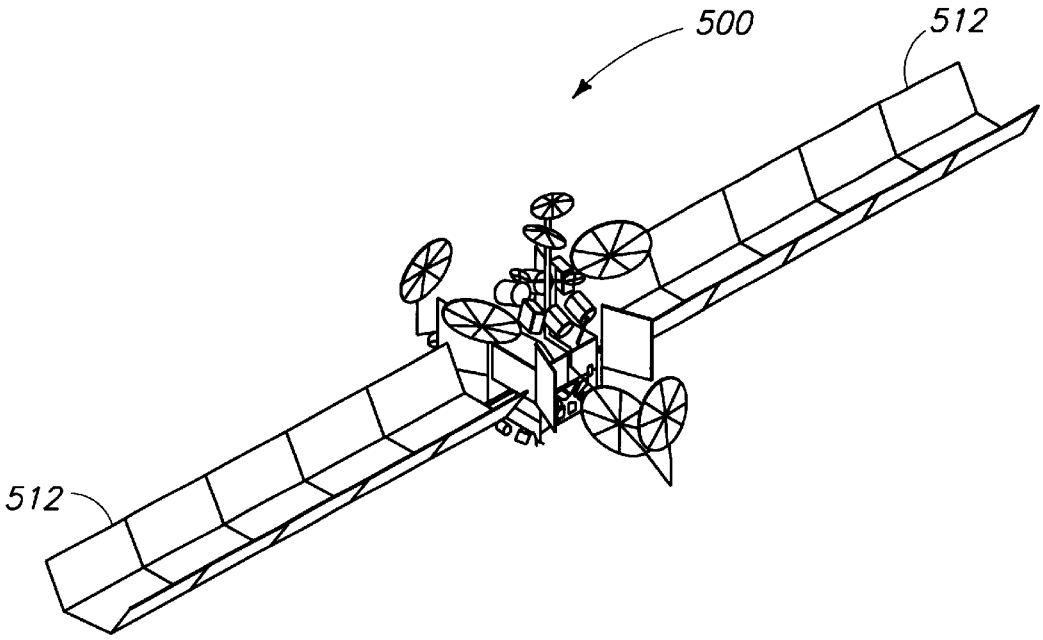
Figure 5D:
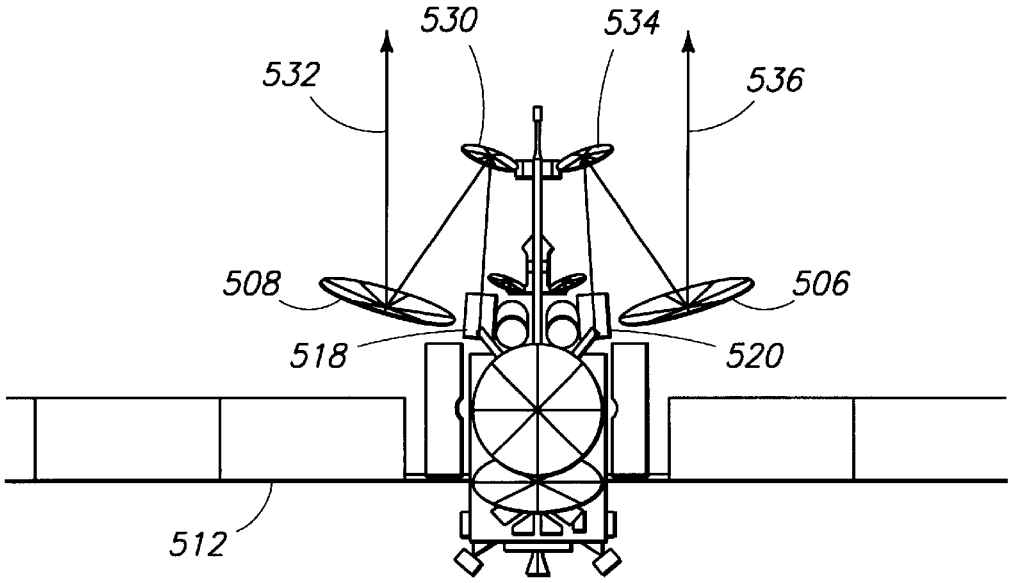
Figure 5E:
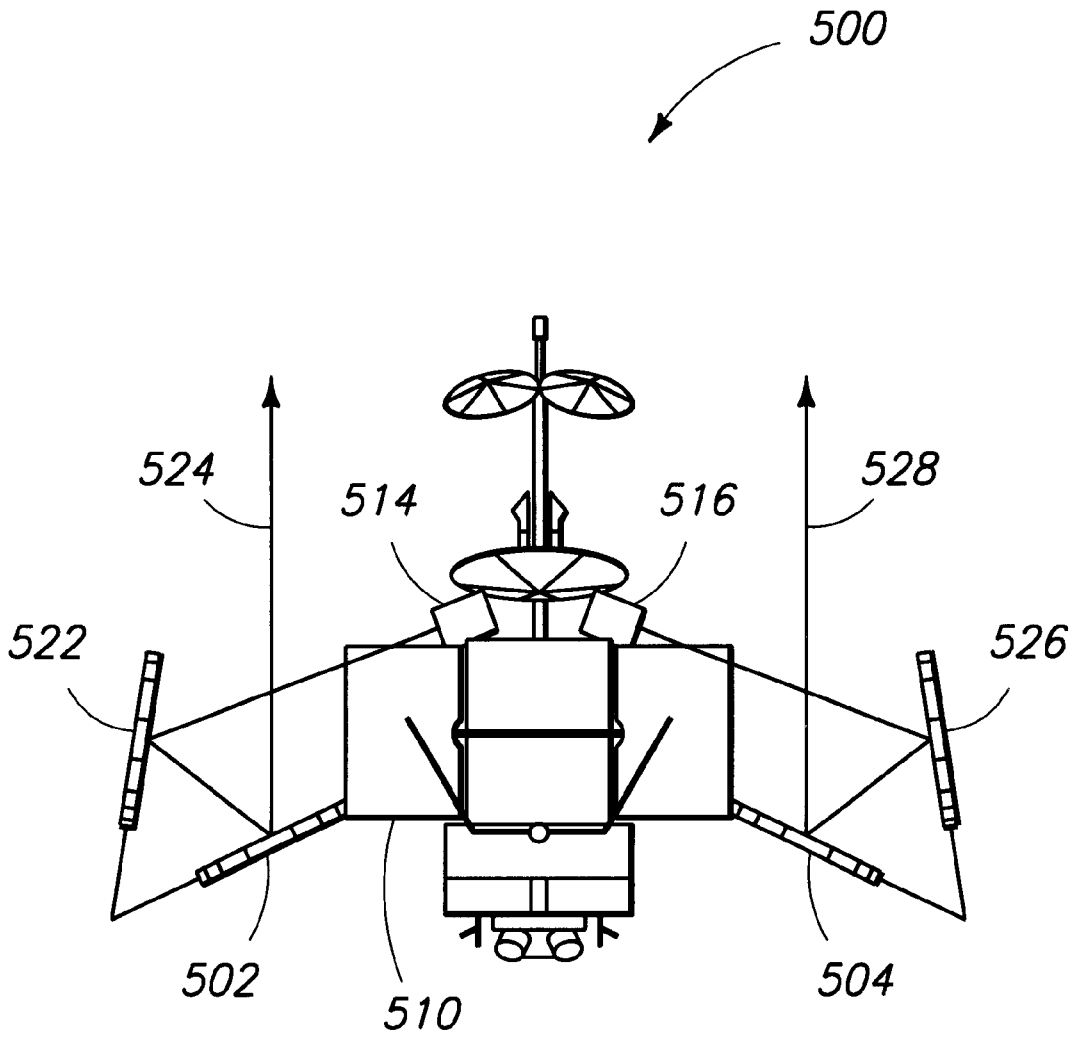

FIG. 4B illustrates an alternative embodiment of the present invention. If a SFOC antenna system as described in FIG. 4A is not possible, for example, due to insufficient spacecraft bus 410 dimensions, or because of launch vehicle constraints or other constraints, a lensed system can be used. In the embodiment of FIG. 4B, antenna 1 402 is now in the North position on the nadir face of spacecraft bus 410, antenna 2 404 is now in the South position on the nadir face of spacecraft bus 410, antenna 3 406 is opposite the East face of spacecraft bus 410, and antenna 4 408 is opposite the West face of spacecraft bus 410. This configuration allows the deployment of antennas 3 406 and 4 408 to be simple, e.g., Gregorian antennas, whereas the nadir face has antenna lenses over antennas 1 402 and 2 404 to provide the wide-scan capabilities required for antennas 1 402 and 2 404. Beam patterns 414 and 416 are generated in a similar fashion to the embodiment described with respect to FIG. 4A.

Mechanical Antenna Configuration

FIGS. 5A–5E illustrate a typical spacecraft antenna configuration employing the present invention.

Spacecraft 500 is illustrated with four antennas 502–508 of approximately one hundred inch diameter. Antennas 502–508 correspond to antennas 402–408 described with respect to FIGS. 4A–4B. Antenna 502 is located on the East face of the spacecraft bus 510, antenna 504 is located on the West face of spacecraft bus 510, antenna 506 is located on the North part of the nadir face of the spacecraft bus 510, and antenna 508 is located on the South part of the nadir face of the spacecraft bus 510. Solar panels 512 are also shown for clarity.

Feed horns 514–520 are also shown. Feed horn 514 illuminates antenna 502, feed horn 516 illuminates antenna 504, feed horn 518 illuminates antenna 506, and feed horn 520 illuminates antenna 508. Feed horn 514 is directed towards subreflector 522, which is aligned with antenna 502 to produce beam 524. Feed horn 516 is directed towards subreflector 526, which is aligned with antenna 504 to produce beam 528. Feed horns 514–520 can be single or multiple sets of feed horns as desired by the spacecraft designer or as needed to produce the beams desired for geographic coverage. For example, feed horns 514 and 516 are shown as two banks of feed horns, but could be a single bank of feed horns, or multiple banks of feed horns, as desired. Beams 524 and 528 are used to produce the spot beams for antennas 502 and 504. Antennas 502 and 504 are shown in an SFOC configuration, which are packaged on the East and West sides of the spacecraft bus 510, as described with respect to FIG. 4A.

Antennas 506 and 508 are shown as offset Gregorian geometry antennas, but can be of other geometric design if desired. The Gregorian antennas 506 and 508 can be used for scanning to within about 4 degrees, and as such cannot be used in both Northern and Southern Hemisphere coverage patterns at the same time. Feed horn 518 illuminates subreflector 530, which is aligned with antenna 508 to produce beam 532. Feed horn 520 illuminates subreflector 534, which is aligned with antenna 506 to produce beam 536. Beams 532 and 536 are used to produce the alternating spots for contiguous spot beam coverage. Antenna 506 is pointed so that its boresight is centered over the northern cluster of beams and is analogous to antenna 406 of FIG. 4A. Similarily, the boresight of antenna 508 is pointed towards the southern cluster of beams, and is analogous to antenna 408 of FIG. 4A.

Figure 6:
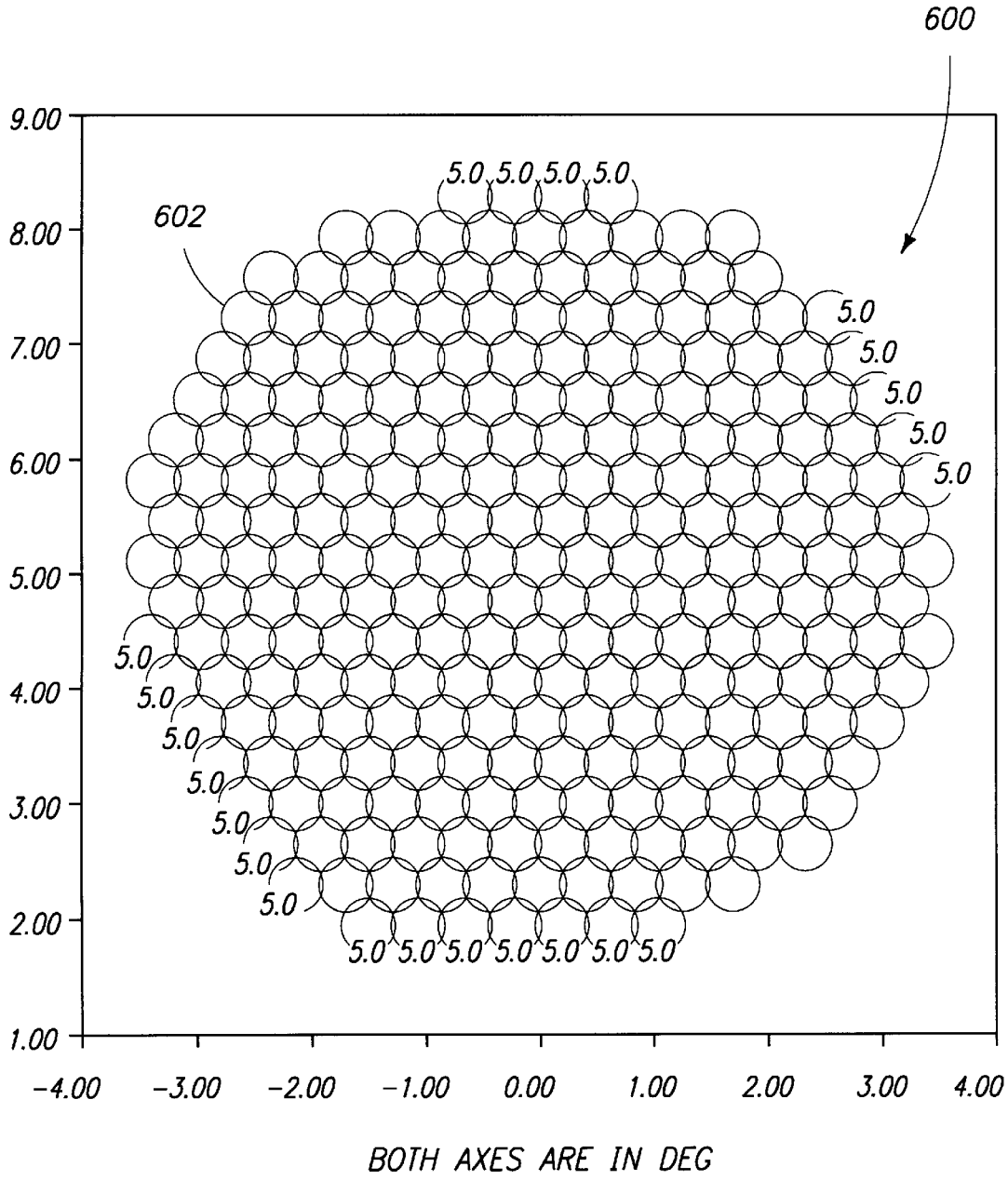
FIG. 6 illustrates the northern hemisphere beam pattern generated by the antenna system of FIG. 5.

FIG. 6 illustrates the northern hemisphere beam pattern generated by the antenna system of FIG. 5. Beam pattern 600 is one of two similar contiguous spot beam patterns generated by the four antenna configuration of the present invention. The beam gain performance of beam pattern 600 is uniform over the whole coverage area 602, even though the individual spot beams are generated from two different types of antennas. The gain variation for the coverage area 602 is within 1.3 dB.

Process Chart

Figure 7:
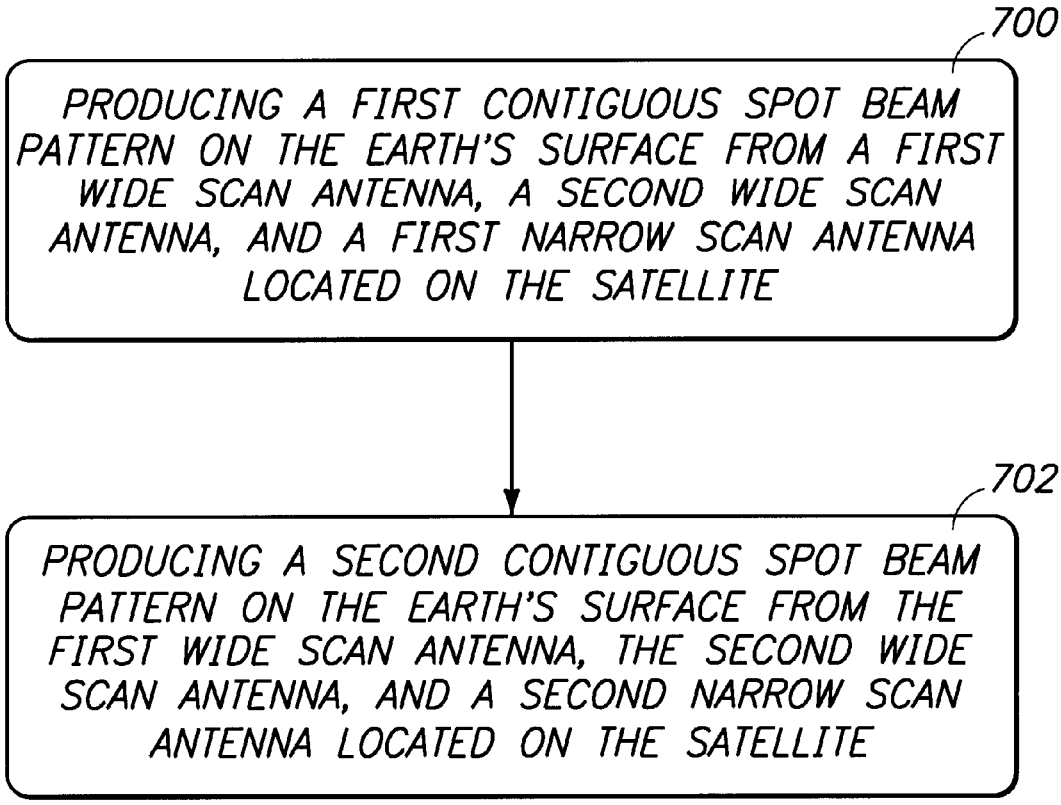
FIG. 7 is a flow chart illustrating the steps used to practice the present invention.

FIG. 7 is a flow chart illustrating the steps used to practice the present invention.

Block 700 illustrates performing the step of producing a first contiguous spot beam pattern on the Earth's surface from a first wide scan antenna, a second wide scan antenna, and a first narrow scan antenna located on the satellite.

Block 702 illustrates performing the step of producing a second contiguous spot beam pattern on the Earth's surface from the first wide scan antenna, the second wide scan antenna, and a second narrow scan antenna.

CONCLUSION

This concludes the description of the preferred embodiment of the invention. The following paragraphs describe some alternative methods of accomplishing the same objects. The present invention, although described with respect to RF systems, can also be used with optical systems to accomplish the same goals. Further, although described with respect to SFOC systems as the wide scan antennas and Gregorian systems as the narrow scan antennas, other antenna systems, such as phased array antennas, individual antenna feeds, or other antenna systems can be used to generate the contiguous spot beam coverage described herein without departing from the scope of the invention.

Further, although described herein as having the two wide scan antennas as being disposed on opposite faces, e.g., East and West faces of the spacecraft bus, the two wide scan antennas can be disposed on the same or other faces of the spacecraft bus, as long as the two wide scan antennas are disposed away from each other on the spacecraft bus enough to generate the two distinct contiguous spot beam patterns. Similarly, although described herein as having the two narrow scan antennas as being oppositely disposed, e.g., the North and South portions of the nadir face of the spacecraft bus, the two narrow scan antennas can be disposed on the same or other faces of the spacecraft bus, as long as the two narrow scan antennas are disposed away from each other on the spacecraft bus enough to generate the two distinct contiguous spot beam patterns.

In summary, the present invention discloses a method and apparatus for producing contiguous spot beam communications coverage on the Earth's surface. The apparatus comprises an antenna system including two wide scan antennas and two narrow scan antennas. The two wide scan antennas are disposed substantially opposite each other, and the two narrow scan antennas are disposed substantially opposite each other and substantially normal to the wide scan antennas. The first wide scan antenna, second wide scan antenna, and first narrow scan antenna produce a first beam pattern on a planetary surface and the first wide scan antenna, second wide scan antenna, and second narrow scan antenna produce a second beam pattern on the planetary surface.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An antenna system for delivering contiguous spot coverage, comprising:

a first wide scan antenna;

a second wide scan antenna, disposed away from the first wide scan antenna;

a first narrow scan antenna; and a second narrow scan antenna, disposed away from the first narrow scan antenna, the first narrow scan antenna and second narrow scan antenna disposed away from the first wide scan antenna and the second wide scan antenna, wherein the first wide scan antenna, second wide scan antenna, and first narrow scan antenna produce a first beam pattern, and the first wide scan antenna, second wide scan antenna, and second narrow scan antenna produce a second beam pattern.

2. The antenna system of claim 1, wherein the first beam pattern is in one hemisphere and the second beam pattern is in another hemisphere.

3. The antenna system of claim 2, wherein the first beam pattern is in the Northern Hemisphere and the second beam pattern is in the Southern Hemisphere.

4. The antenna system of claim 1, wherein the first wide scan antenna is located on an East face of a spacecraft bus and the second wide scan antenna is located on a West face of the spacecraft bus.

5. The antenna system of claim 4, wherein the first wide scan antenna and the second wide scan antenna are side-fed offset cassegrain antennas.

6. The antenna system of claim 4, wherein the first narrow scan antenna and the second narrow scan antenna are offset Gregorian antennas.

7. The antenna system of claim 1, wherein the first wide scan antenna is located on a North position of a nadir face of a spacecraft bus and the second wide scan antenna is located on a South position of the nadir face of the spacecraft bus.

8. The antenna system of claim 7, wherein the first wide scan antenna and the second wide scan antenna are lensed antennas.

9. The antenna system of claim 1, wherein at least one of the first wide scan antenna and the second wide scan antenna is a phased array antenna.

10. A method of for producing at least two contiguous spot beam patterns for communications from a satellite to the Earth's surface, comprising the steps of:

producing a first contiguous spot beam pattern on the Earth's surface from a first wide scan antenna, a second wide scan antenna, and a first narrow scan antenna located on the satellite; and producing a second contiguous spot beam pattern on the Earth's surface from the first wide scan antenna, the second wide scan antenna, and a second narrow scan antenna.

11. The method of claim 10, wherein the first wide scan antenna is disposed substantially opposite to the second wide scan antenna.

12. The method of claim 10, wherein the first narrow scan antenna is disposed substantially opposite to the second narrow scan antenna.

13. The method of claim 10, wherein the first the first wide scan antenna is disposed substantially opposite to the second wide scan antenna, the first narrow scan antenna is disposed substantially opposite to the second narrow scan antenna, and the first narrow scan antenna and the second narrow scan antenna are disposed substantially normal to the first wide scan antenna and the second wide scan antenna.

14. The method of claim 10, wherein the first contiguous spot beam pattern is in one hemisphere and the second contiguous spot beam pattern is in another hemisphere.

15. The method of claim 14, wherein the first contiguous spot beam pattern is in the Northern hemisphere and the second contiguous spot beam pattern is in the Southern hemisphere.

16. The method of claim 10, wherein the first wide scan antenna is located on an East face of a spacecraft bus and the second wide scan antenna is located on a West face of the spacecraft bus.

17. The method of claim 16, wherein the first wide scan antenna and the second wide scan antenna are side-fed offset cassegrain antennas.

18. The method of claim 16, wherein the first narrow scan antenna and the second narrow scan antenna are offset Gregorian antennas.

19. The method of claim 10, wherein the first wide scan antenna is located on a North position of the nadir face of a spacecraft bus and the second wide scan antenna is located on a South position of the nadir face of the spacecraft bus.

20. The method of claim 19, wherein the first wide scan antenna and the second wide scan antenna are lensed antennas.

21. The method of claim 10, wherein at least one of the first wide scan antenna and the second wide scan antenna is a phased array antenna.

22. A signal broadcast from a satellite, formed by performing the steps of:

producing a first contiguous spot beam pattern on the Earth's surface from a first wide scan antenna, a second wide scan antenna, and a first narrow scan antenna located on the satellite; and producing a second contiguous spot beam pattern on the Earth's surface from the first wide scan antenna, the second wide scan antenna, and a second narrow scan antenna, wherein the signal is at least a portion of one of the first contiguous spot beam pattern and the second contiguous spot beam pattern.

* * * * *